US006163243A

United States Patent [19]

Titus

[11] Patent Number: 6,163,243

[45] Date of Patent: Dec. 19, 2000

[54] TOROIDAL CURRENT TRANSFORMER ASSEMBLY AND METHOD

[75] Inventor: Solomon R. Titus, Alpharetta, Ga.

[73] Assignee: Siemens Energy & Automation, Inc., Alpharetta, Ga.

[21] Appl. No.: 09/107,350

[22] Filed: Jun. 30, 1998

[51] Int. Cl.[7] ..... H01F 38/20

[52] U.S. Cl. ..... 336/174; 336/175; 336/192; 336/196; 336/199; 336/229

[58] Field of Search ..... 336/174, 175, 336/229, 65, 67, 185, 192, 199, 196; 29/606, 602.1; 439/810–814

[56] References Cited

U.S. PATENT DOCUMENTS

| | | | |
|---|---|---|---|
| 1,059,120 | 4/1913 | Cotton | 336/67 |
| 1,467,973 | 9/1923 | Hunt et al. | 336/67 |
| 1,645,941 | 10/1927 | Williams | 336/67 |
| 1,667,945 | 5/1928 | Nicosia et al. | 336/116 |
| 1,731,013 | 10/1929 | Laughter | 335/65 |
| 2,194,502 | 3/1940 | Hower | 336/65 |
| 2,513,965 | 7/1950 | Pettit | 336/67 |
| 2,559,988 | 7/1951 | Noyes, Jr. | 336/192 |
| 2,560,926 | 7/1951 | Bronell | 336/67 |
| 2,629,832 | 2/1953 | Hansen et al. | 378/98 |
| 2,695,387 | 11/1954 | Clark et al. | 29/602.1 |
| 2,721,961 | 10/1955 | Votaw | 361/289 |
| 2,841,772 | 7/1958 | Sloop | 336/67 |
| 2,864,992 | 12/1958 | Fredrickson | 336/148 |
| 2,892,167 | 6/1959 | Ritz | 336/174 |
| 2,896,180 | 7/1959 | Brown | 336/155 |
| 2,910,663 | 10/1959 | Wilk et al. | 336/210 |
| 2,929,037 | 3/1960 | Breth et al. | 336/174 |
| 3,036,246 | 5/1962 | Valleau | 336/67 |
| 3,041,561 | 6/1962 | Hannon et al. | 336/84 R |
| 3,160,843 | 12/1964 | Thorpe . | |
| 3,268,843 | 8/1966 | Popp | 336/223 |
| 3,278,876 | 10/1966 | Coulombe et al. | 336/192 |
| 3,308,247 | 3/1967 | Doersam et al. | 191/12.2 R |
| 3,965,451 | 6/1976 | De Vos | 336/67 |
| 4,084,143 | 4/1978 | Nutt | 336/65 |
| 4,098,643 | 7/1978 | Brown | 176/3 |
| 4,507,709 | 3/1985 | Morris et al. | 361/400 |
| 4,571,569 | 2/1986 | Scharl | 336/65 |
| 4,754,250 | 6/1988 | Duin | 336/65 |
| 4,868,533 | 9/1989 | Ehrenhalt et al. | 336/82 |
| 4,878,291 | 11/1989 | Suguri | 29/606 |
| 5,307,043 | 4/1994 | Dvorak et al. | 335/174 |
| 5,319,341 | 6/1994 | Bisbee et al. | 336/67 |
| 5,583,732 | 12/1996 | Seymour et al. . | |

FOREIGN PATENT DOCUMENTS

| | | |
|---|---|---|
| 2 396 398 | 1/1979 | France . |
| 35 21 518 | 11/1986 | Germany . |
| 782 264 | 9/1957 | United Kingdom . |

OTHER PUBLICATIONS

European Search Report dated Oct. 10, 1999 (3 pages).

*Primary Examiner*—Lincoln Donovan
*Assistant Examiner*—Tuyen Nguyen

[57] ABSTRACT

A current transformer assembly comprises a toroidal core and a conductor having a body portion and a mounting portion. The conductor's body portion extends through the aperture of the toroidal core. The mounting portion is positioned for a mechanical and electrical connection between an external conductor and the current transformer. A connection is made between the body portion and the mounting portion wherein mechanical engagement is sufficient to prevent unintended separation of the body portion from the mounting portion and electrical coupling is sufficient to permit the flow of current between the body portion and the mounting portion.

19 Claims, 3 Drawing Sheets

TOROIDAL CURRENT TRANSFORMER ASSEMBLY AND METHOD

BACKGROUND OF THE INVENTION

This invention relates to a current transformer assembly and, in particular, to a current transformer including a toroidal core with a winding and a circular aperture extending therethrough.

FIELD OF THE INVENTION

Current transformer assemblies are often positioned between the line side of a trip unit of a circuit breaker and the load side in order to monitor the current therebetween. One type of current transformer assembly generally includes a doughnut-shaped toroidal core with a winding of wire positioned on the core, wherein the core generally includes a central, circular aperture. In a current transformer assembly that is used as a trip unit, the conductor extends through the aperture of the toroidal core and the conductor is connected between the line side and load side.

Conventional current transformers often use a custom one-piece die-cast bus component to form the conductor that extends through the toroidal core. Such a bus component requires custom tooling to form the die with which it is produced. Custom tooling can be quite expensive especially when the quantity of a particular bus conductor to be manufactured is small and the cost of the tooling cannot be spread out over a large quantity of parts to reduce the per piece tooling cost.

Other conductors have been formed by a one-piece metal stamping. Such a stamping also requires tooling which can be quite expensive for short production runs. Also, a one-piece metal stamping formed from a sheet or plate of conductive material cannot be any larger in thickness than the aperture of the toroidal core. Accordingly, the stamped conductor's cross-sectional area is significantly smaller than the area of the core's aperture because it would have a square or rectangular cross sectional shape that would necessarily create significant gaps between the outer surface of the conductor and the inner surface of the toroidal core's circular aperture. This results in a conductor having a cross-section smaller than it needs to be.

It is also recognized that toroidal cores are not very easy to secure in conjunction with other circuit elements. This is true on the one hand because they are relatively heavy and, on the other hand, because they do not allow a direct, mechanical fastening to other circuit components since the toroidal core is completely surrounded by a fragile wire winding. Also, any significant relative motion between the toroidal core and other circuit elements should be avoided in order to eliminate damage to the electrical connections between the circuit elements.

U.S. Pat. No. 4,754,250, issued to Albert Duin, describes a holding device for toroidal cores. The Duin patent describes conventional toroidal cores clamped between two plates. According to Duin, such a construction has a disadvantageous effect by exerting a high pressure on the winding of the toroidal core itself, thereby damaging the insulation of the individual windings. Instead, Duin suggests a holding arrangement wherein a wound toroidal core is positioned over a vertically-oriented centering arbor of a carrier plate.

Despite such attempts to mount a toroidal core, there remains a need for a low-cost current transformer assembly wherein the toroidal core is securely mounted mechanically and electrically in order to reduce any possible damage to the core and its windings.

SUMMARY OF THE INVENTION

In order to overcome the disadvantages associated with the prior art, an improved current transformer assembly has been discovered. It includes a toroidal core with a winding that is positioned on the core. The core has a central aperture that is preferably substantially circular. A conductor is provided for use in the current transformer which has a body portion and a mounting portion positioned adjacent to the body portion. The body portion of the conductor extends through the aperture of the toroidal core, wherein the body portion preferably has a substantially circular cross-sectional shape. The mounting portion of the conductor is positioned for mechanical and electrical connection between an external conductor (such as a line bus or a load bus) and the conductor's body portion. A connection is made between the body portion and the mounting portion to provide mechanical engagement sufficient to prevent unintended separation of the body portion from the mounting portion. The connection also provides electrical coupling to permit the flow of current between the body portion and the mounting portion.

The conductor of the current transformer preferably includes a load side mounting portion as well as a line side mounting portion. Also, the body portion of the conductor is preferably formed from a conductive rod having an outer diameter that approaches an inner diameter of the aperture of the toroidal core.

A fastener such as a threaded fastener or a rivet can be used to connect the body portion to the mounting portion of the conductor. Alternatively, the connection can be made by means of a weld or by other equivalent connections.

The mounting portion of the conductor is preferably formed from a conductive sheet. An end portion of the body portion of the conductor can extend through a recess formed in the mounting portion of the conductor.

DETAILED DESCRIPTION OF THE INVENTION

Figure 1:
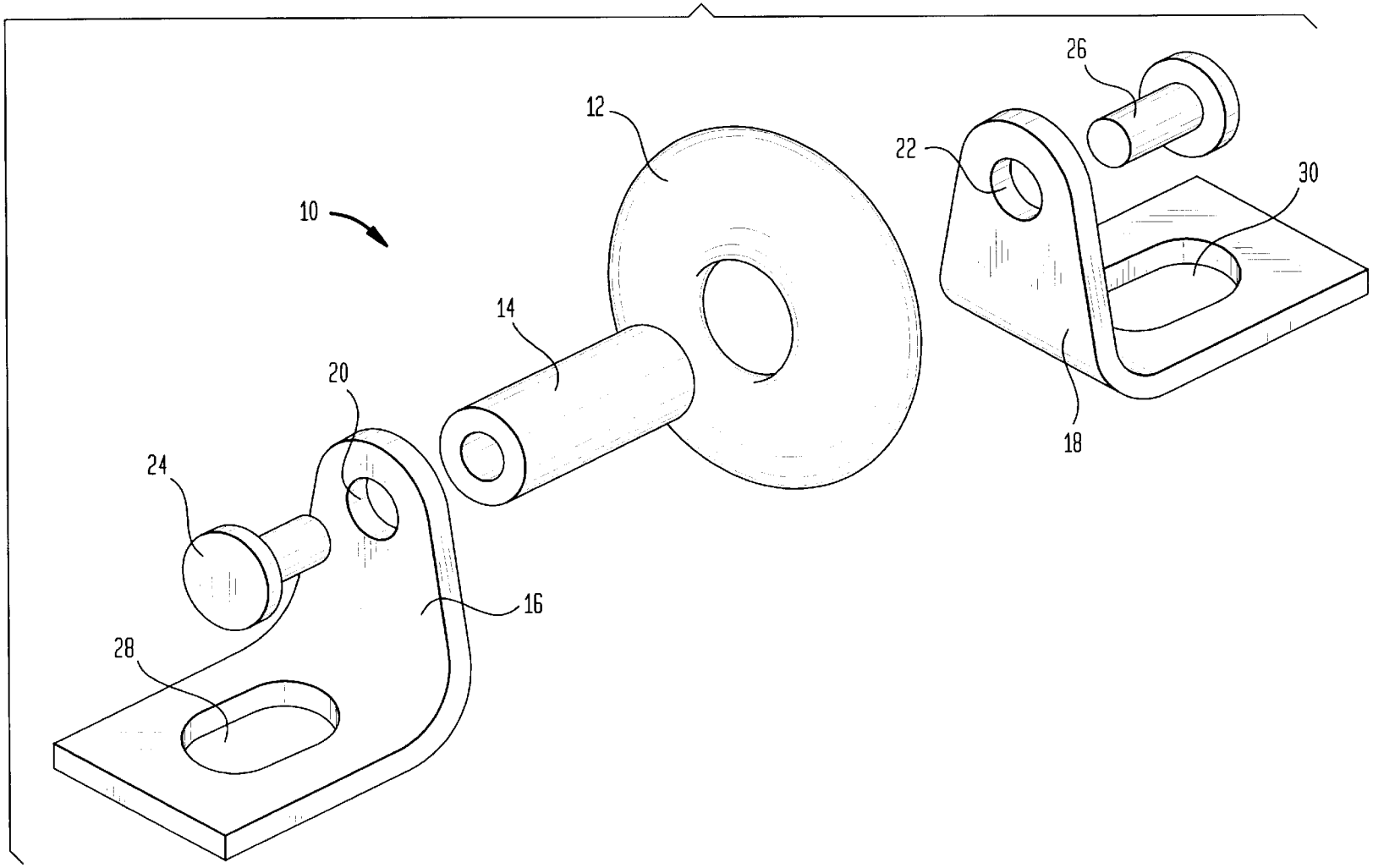
FIG. 1 is an exploded perspective view of an embodiment of a current transformer assembly according to this invention.

Several embodiments of the invention have been selected for illustration in the drawings. It will be appreciated that the following description and the drawings are not intended to limit the scope of this invention and that the drawings are not intended to be to scale or to proportion. The invention is defined separately in the appended claims.

Generally speaking, the current transformer assembly according to this invention provides a conductor assembly that provides both a low-cost electrical conductor for extension through the aperture of the toroidal core as well as a means for mounting the toroidal core with respect to other circuit components. This dual function of the conductor assembly provides a low-cost current transformer assembly that is inexpensive and easy to produce while providing optimal performance.

Figure 2:
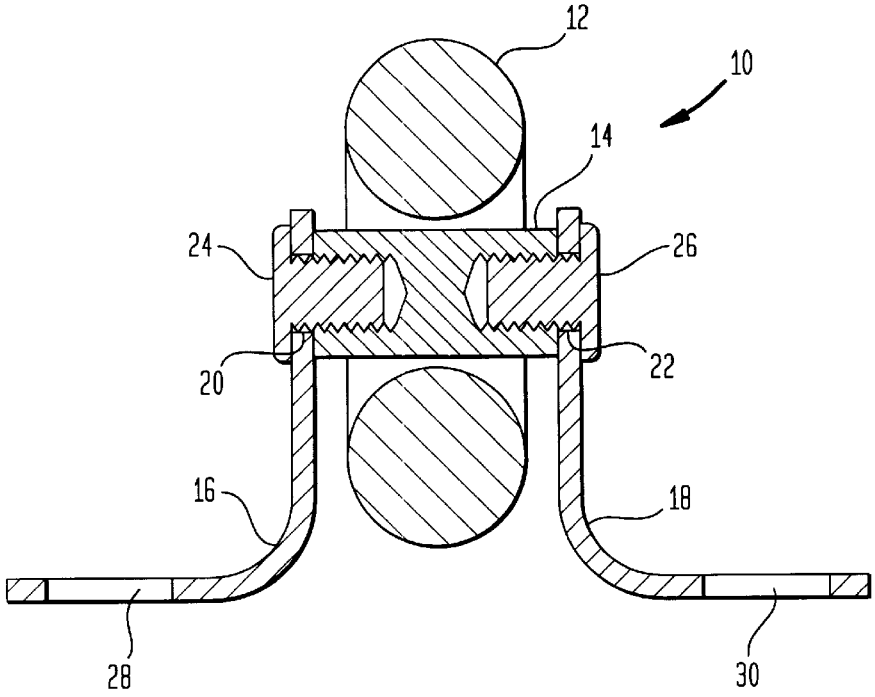
FIG. 2 is a cross-sectional side view of the current transformer assembly shown in FIG. 1.

Referring to FIGS. 1 and 2, an embodiment of a current transformer assembly according to this invention is generally designated by the numeral "10". It includes a substantially doughnut-shaped toroidal core 12 that has a winding positioned on it in the usual manner. It also includes a central, substantially circular aperture that extends all the way through the toroidal core. Such toroidal cores are well known in the art.

The remaining components shown in FIGS. 1 and 2 together combine to form the bus-like conductor. A body portion 14 of the conductor is provided with female threads such as straight threads that extend into its end surfaces. The female threads can be machined into blind holes provided in the body portion 14 along the body's axis. Alternatively, the female threads can be formed in a tubular body portion 14 that has a hollow inner surface into which the female threads can be easily machined. Body portion 14 of the conductor is most preferably formed from inexpensive copper rod of standard, stock diameter that is preferably silver plated for maximum conductivity. Body portion 14 is easily manufactured simply by cutting a piece of standard copper rod to the desired length (depending upon the thickness of the toroidal core and windings assembly) and by machining the female threads in its ends. Although body portion 14 is preferably formed from rod stock, it can also be formed from standard tubular stock, as described earlier, by cutting the tube to length and by adding the female threads at its ends using conventional machining processes.

The conductor also includes a load side mounting portion 16 as well as a line side mounting portion 18, which are substantially mirror images of one another. Mounting portions 16 and 18 are preferably formed from standard copper plate or sheet. The mounting portion components can simply be manufactured by stamping shapes from stock sheet having a stock thickness, drilling the appropriate mounting holes (including recesses 20 and 22 and mounting recesses 28 and 30), and finally by bending the stamped sheet into the configuration shown in FIGS. 1 and 2. The mounting portions 16 and 18 are also preferably plated with a conductive coating such as a silver plating. Mounting portions 16 and 18 each have a portion such as a vertical leg that extends along the sides of toroidal core 12 in a radial direction relative to the axis of the core's aperture. The vertical legs are sufficiently tall to extend to a position that is radially spaced with respect to an outer diameter of the toroidal core. This structure permits the use of mounting portions 16 and 18 to mount toroidal core 12 on a surface in such a way as to avoid contact between the outer diameter of the core (and its windings) and the mounting surface.

Mounting portions 16 and 18 each also include a portion such as a horizontal leg that preferably extends at a right angle with respect to the vertical leg. The mounting recesses 28 and 30 are positioned in the horizontal legs to facilitate electrical and mechanical connection between the mounting portions and other circuit components such as a line bus on one side and a load bus on the other. Recesses 28 and 30 are preferably elongated slots to permit alignment with mating components.

In order to make a connection between the mounting portions 16 and 18 and the body portion 14 of the conductor, a load side screw fastener 24 and a line side screw fastener 26 are engaged in the female threads at both ends of body portion 14; more specifically, load side screw fastener 24 is inserted through recess 20 in load side mounting portion 16 for threaded connection to the body portion 14. Similarly, line side screw fastener 26 is inserted through recess 22 in line side mounting portion 18 for threaded connection to the female threads in body portion 14. Mounting recess 28 in load side mounting portion 16 and mounting recess 30 in line side mounting portion 18 are provided so that each of the mounting portions 16 and 18 can be securely mounted to any desired surface such as a line side bus or a load side bus, as described earlier.

It will be appreciated that the conductor of the current transformer assembly is formed by connection between the load side mounting portion 16, load side screw fastener 24, body portion 14, line side screw fastener 26, and line side mountain portion 18. Such assembly creates a securely connected and high quality electrical conductor. It also at the same time provides a sturdy mounting structure for the toroidal core 12 in such a way as to protect the various windings around the toroidal core from damage. These benefits are achieved at a low-cost by using standard components and stock material such as standard-sized copper sheet, stock copper rod or tube, and off-the-shelf fasteners. Although a wide variety of fastener materials can be used, the screw fasteners 24 and 26 are preferably silver plated or otherwise plated metallic screws. Each of the conductor components is preferably plated with silver or another conductive material to ensure adequate electrical connection.

Figure 3A:
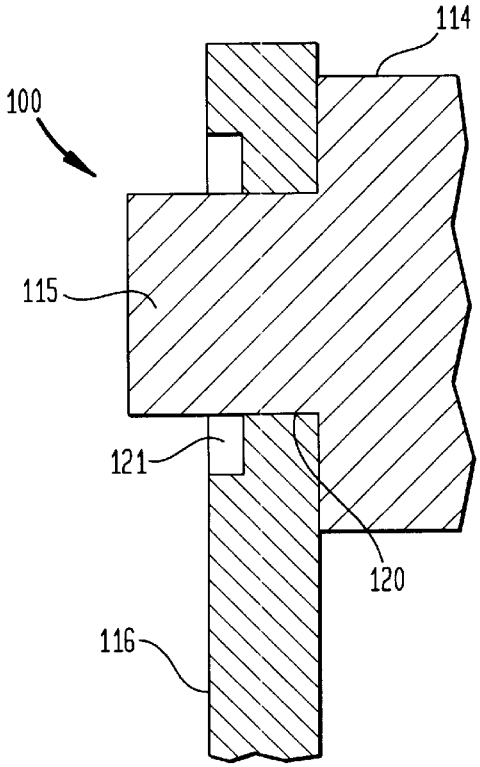
FIG. 3A is a cross-sectional side view of a cut-away portion of another embodiment of a current transformer assembly according to this invention, before components of the conductor are fastened.
Figure 3B:
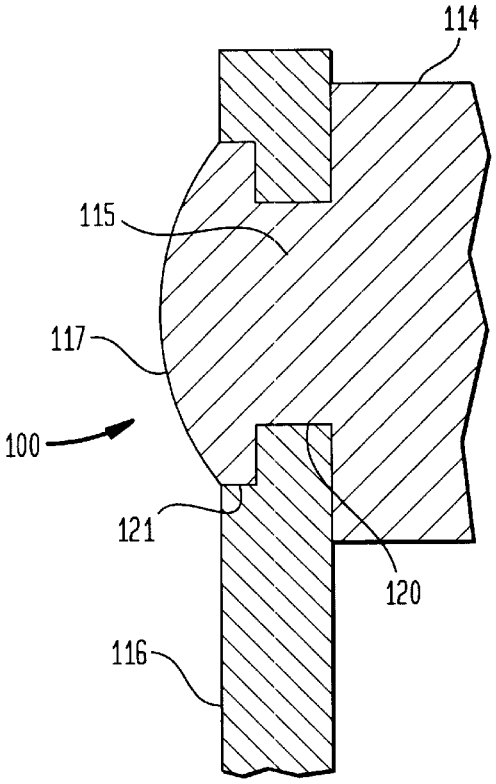
FIG. 3B is a cross-sectional side view of a cut-away portion of the current transformer assembly shown in FIG. 3A subsequent to fastening of the conductor components.

Referring now to FIGS. 3A and 3B, another embodiment of a current transformer assembly according to this invention will now be described. In this embodiment, the current transformer assembly is generally designated by the numeral "100". The primary difference between current transformer assembly 100 and current transformer assembly 10 is the manner in which the conductor components are connected. As an alternative to the screw fastener used to connect mounting portions 16 and 18 to the opposite ends of body portion 14 in current transformer assembly 10, the mounting portions of this embodiment are connected by means of a mechanical rivet.

Referring specifically to FIG. 3A, a body portion 114 is provided with a reduced diameter portion 115 at both ends (only one end is shown). The load side mounting portion 116 is provided with a recess 120 as well as a counterbore 121 adjacent to the recess 120 and sharing an axis with recess 120. The reduced diameter portion 115 of body portion 114 is positioned to extend through the recess 120 and counterbore 121 of the load side mounting portion 116. The size of counterbore 120 is selected to correspond to the size of the reduced diameter portion 115 for reasons that will become clear later with reference to FIG. 3B.

As illustrated in FIG. 3B, a spin-riveting procedure is performed in order to provide secure mechanical and electrical engagement between body portion 114 and load side mounting portion 116. More specifically, the reduced diameter portion 115 of body portion 114 is deformed toward the outer surface of the load side mounting portion 116 so that the end portion of the body portion 114 fills the counterbore region 121 formed in mounting portion 116. This procedure creates a rivet head 117 that substantially fills the counterbore 121 and leaves the rivet head substantially flush with the outer surface of the load side mounting portion 116.

Figure 4:
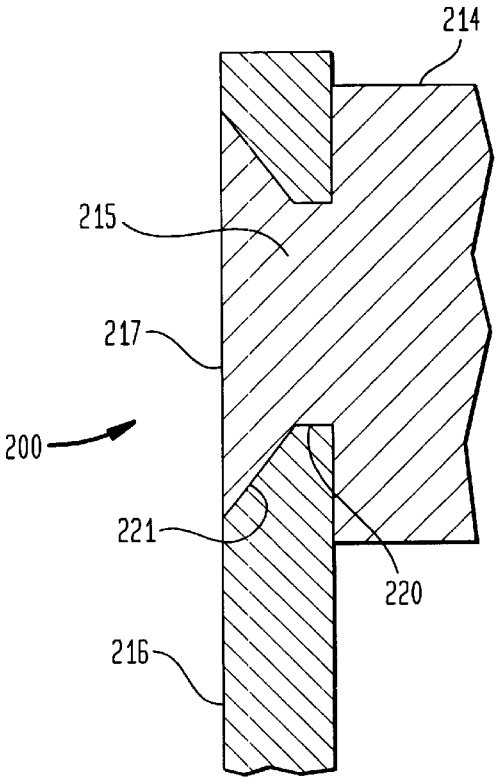
FIG. 4 is a cross-sectional side view of a cut-away portion of yet another embodiment of a current transformer assembly according to this invention subsequent to fastening of the conductor components.

Referring now to FIG. 4, yet another embodiment of a current transformer assembly "200" will now be described.

This embodiment is similar to the one illustrated in FIGS. 3A and 3B in that a riveting procedure is performed in order to provide secure mechanical and electrical engagement between the body portion and mounting portion of the conductor. Current transformer assembly 200 differs in the configuration of the rivet joint. More specifically, the load side mounting portion 216 is provided with a recess 220 as well as an angled counterbore or countersink 221. The end portion 215 of body portion 214 is positioned to extend through the recess 220 and countersink 221 of the load side mounting portion 216. The end portion 215 of body portion 214 is deformed so that it fills the countersink region 221. This procedure creates a rivet head 217 that is substantially flush with the outer surface of the load side mounting portion 216.

Although rivets as well as threaded fasteners have been described and illustrated in the drawings as means for connecting the body portion of the conductor to the mounting portion or portions, other connecting means are contemplated as well. For example, a weldment can replace the screw fasteners 24 and 26 of current transformer assembly 10 as well as the rivet heads 117 and 217 of current transformer assemblies 100 and 200. Also, instead of forming a rivet head from portions 115 and 215 to connect the components, it is also contemplated that portions 115 and 215 can be provided with male threads and a nut can be assembled on the other side of mounting portions 116 and 216 in order to bring the components together. Also, other rivet configurations and other mechanical fastening arrangements are also contemplated. In any event, it remains important for the connection of the conductor components to provide a strong structural connection as well as a reliable electrical coupling.

Although particular materials and component configurations have been described herein and shown in the drawings for purposes of illustration, such materials and configurations can be substituted for equivalent materials and configurations so long as their intended functions are maintained and preserved.

Also, although not shown, it is contemplated that the current transformer assembly may be encapsulated in a so-called "trip case". For example, such a trip case might be provided with a thermoset plastic base of heat-resistant material and/or a thermoplastic cover in order to encapsulate and protect the components of the assembly from external damage. If so, horizontal legs of a mounting portion of the conductor can extend from the encapsulated trip case for mounting the trip case and for electrical connection. Also, it is contemplated that it may be preferred to plate every component of the conductor with silver or another conductive material to maximize the stability of the electrical connections. Although two mounting portions are illustrated in the drawings, only one may be required depending on the configuration and positioning of external circuit components to which the assembly is intended to be connected. Also, the shape of the mounting portions is not important to the invention.

Other modifications of the embodiments selected for illustration in the drawings are contemplated as well and the embodiments selected for illustration should not be deemed to limit the spirit or scope of the invention which, instead, is defined in the appended claims.

What is claimed is:

1. A current transformer assembly comprising:

a toroidal core defining an aperture;

a conductor comprising a body portion extending through said aperture of said toroidal core and having at least one end portion of reduced thickness, said conductor further comprising at least one mounting portion positioned adjacent to said body portion, said mounting portion defining a recess and a counterbore or a countersink adjacent said recess positioned to receive said end portion of said body portion, and said end portion of said body portion having a head contacting a surface of said counterbore or said countersink for engagement of said mounting portion and said body portion;

said engagement of said mounting portion and said body portion providing mechanical engagement sufficient to prevent unintended separation of said body portion from said mounting portion, said engagement of said mounting portion and said body portion further providing electrical coupling to permit a flow of current between said body portion and said mounting portion.

2. The current transformer assembly defined in claim 1, said body portion comprising opposed end portions of reduced thickness and said conductor comprising plural mounting portions, one of said mounting portions being positioned adjacent to each of said end portions of said body portion, each of said mounting portions defining a recess and a counterbore or a countersink adjacent said recess positioned to receive one of said end portions of said body portion, and each of said end portions of said body portion having a head contacting a surface of said counterbore or said countersink for engagement of one of said mounting portions.

3. The current transformer assembly defined in claim 1, wherein said aperture of said toroidal core is circular.

4. The current transformer assembly defined in claim 3, wherein said body portion of said conductor has a circular cross-sectional shape and wherein an outer diameter of said body portion approaches an inner diameter of said aperture of said toroidal core.

5. The current transformer assembly defined in claim 1, wherein said mounting portion is formed from a conductive sheet.

6. The current transformer assembly defined in claim 1, wherein an outwardly facing surface of said body portion of said conductor is positioned against an inwardly facing surface of said mounting portion of said conductor.

7. The current transformer assembly defined in claim 1, wherein said end portion of said body portion has a reduced diameter portion configured to extend through said recess defined in said mounting portion.

8. The current transformer assembly defined in claim 1, said body portion of said conductor comprising a rod.

9. The current transformer assembly defined in claim 1, wherein at least contacting surfaces of said body portion and said mounting portion of said conductor are plated with a conductive material.

10. A current transformer assembly comprising:

a toroidal core defining an aperture;

a conductor comprising a body portion extending through said aperture of said toroidal core and having opposed end portions of reduced thickness, said conductor further comprising a mounting portion positioned adjacent to one of said end portions of said body portion and a mounting portion adjacent to an opposite one of said end portions of said body portion, each of said mounting portions defining a recess and a counterbore or a countersink ii sharing an axis with said recess and positioned to receive one of said end portions of said body portion, each of said end portions having a head contacting a surface of one of said counterbores or said countersinks for engagement of said mounting portions and said body portion;

said mounting portions of said conductor each being configured for mechanical and electrical connection between an external conductor and said body portion;

said engagement of said mounting portions and said body portion providing mechanical engagement between said mounting portions and said body portion sufficient to prevent unintended separation of said body portion from said mounting portions; and said engagement of said mounting portions and said body portion also providing electrical coupling between said mounting portions and said body portion sufficient to permit a flow of current through said body portion and said mounting portions.

11. The current transformer assembly defined in claim 10, wherein said body portion is formed from a conductive rod.

12. The current transformer assembly defined in claim 10, wherein said mounting portions are formed from conductive sheet.

13. The current transformer assembly defined in claim 10, wherein each of said end portions of said body portion has a reduced diameter portion configured to extend through said recess defined in one of said mounting portions.

14. The current transformer assembly defined in claim 10, each of said end portions being flush with an outer surface of one of said mounting portions.

15. A method for assembling a current transformer having a toroidal core with an aperture, said method comprising the steps of:

(a) providing a conductor body portion having at least one end portion of reduced thickness;

(b) providing a conductor mounting portion defining a recess and a counterbore or a countersink adjacent said recess positioned to receive said end portion of said conductor body portion;

(c) positioning said conductor body portion to extend through said aperture of said toroidal core, and positioning said end portion of said conductor body portion through said recess defined in said mounting portion; and (d) deforming said end portion of said conductor body portion into contact with a surface of said counterbore or said countersink thereby engaging said conductor mounting portion to provide a mechanical connection sufficient to prevent unintended separation of said conductor body portion from said conductor mounting portion and to provide an electrical connection sufficient to permit a flow of current between said conductor body portion and said conductor mounting portion.

16. A method for assembling a current transformer having a toroidal core with an aperture, said method comprising the steps of:

(a) forming from a conductive rod a conductor body portion having opposed end portions of reduced diameter;

(b) forming from conductive sheet conductor mounting portions each defining a recess and a counterbore or a countersink sharing an axis with said recess;

(c) positioning said conductor body portion to extend through said aperture of said toroidal core, and positioning each of said end portions of said conductor body portion to extend through said recess in one of said conductor mounting portions;

(d) deforming each of said end portions of said conductor body portion to contact a surface of said counterbore or said countersink of one of said conductor mounting portions to engage said conductor mounting portions to provide a mechanical connection sufficient to prevent unintended separation of said conductor body portion from said conductor mounting portions and to provide an electrical connection sufficient to permit a flow of current between said conductor body portion and said conductor mounting portions.

17. The method defined in claim 15, said deforming step comprising spin-riveting said end portion of said conductor body portion.

18. The method defined in claim 16, said deforming step comprising spin-riveting each of said end portions of said conductor body portion toward an outer surface of one of said conductor mounting portions to at least partially fill said counterbore or said countersink defined in said conductor mounting portion.

19. The current transformer assembly defined in claim 1, wherein a shoulder is defined by said end portion of said conductor and wherein said mounting portion is engaged adjacent said shoulder.

* * * * *